US005241938A

United States Patent [19]

Takagi et al.

[11] Patent Number: 5,241,938

[45] Date of Patent: Sep. 7, 1993

[54] INJECTOR WITH ASSIST AIR PASSAGE FOR ATOMIZING FUEL

[75] Inventors: Takaai Takagi; Hiroshi Oda; Takashi Okada, all of Obu, Japan

[73] Assignee: Aisan Kogyo Kabushiki Kaisha, Obu, Japan

[21] Appl. No.: 662,629

[22] Filed: Feb. 28, 1991

[30] Foreign Application Priority Data

| | | | |
|---|---|---|---|
| Mar. 14, 1990 | [JP] | Japan | 2-63078 |
| Mar. 29, 1990 | [JP] | Japan | 2-82484 |
| Mar. 29, 1990 | [JP] | Japan | 2-82485 |

[51] Int. Cl.[5] ..... F02M 23/12; F02M 23/14

[52] U.S. Cl. ..... 123/472; 123/585; 239/533.003; 239/DIG. 19; 239/900; 239/585.4

[58] Field of Search ..... 123/470, 472, 531, 533, 123/585; 239/533.2-533.11, 585

[56] References Cited

U.S. PATENT DOCUMENTS

| | | | |
|---|---|---|---|
| 4,007,880 | 2/1977 | Hans et al. | 239/585 |
| 4,289,104 | 9/1981 | Takada et al. | 123/585 X |
| 4,351,304 | 9/1982 | Schweizer | 123/585 |
| 4,465,050 | 8/1984 | Igashira et al. | 123/533 X |
| 4,657,189 | 4/1987 | Iwata et al. | 239/585 |
| 4,676,216 | 6/1987 | Ohsawa et al. | 123/533 |
| 4,982,716 | 1/1991 | Takeda et al. | 123/470 X |
| 4,982,901 | 1/1991 | Holzgrefe | 239/585 X |

FOREIGN PATENT DOCUMENTS

| | | | |
|---|---|---|---|
| 217248 | 9/1961 | Austria | 239/585 |
| 97064 | 6/1982 | Japan | 123/470 |
| 176332 | 10/1982 | Japan | 123/585 |
| 179367 | 11/1982 | Japan | 123/585 |
| 119966 | 7/1983 | Japan | 123/585 |
| 1270945 | 4/1972 | United Kingdom | 123/470 |
| 2034403 | 6/1980 | United Kingdom | 239/585 |

*Primary Examiner*—Tony M. Argenbright

*Attorney, Agent, or Firm*—Dennison, Meserole, Pollack & Scheiner

[57] ABSTRACT

A fuel injector including a valve housing having a nozzle for columnarly injecting fuel and a valve seat continuing from the nozzle; a valve body reciprocatably mounted in the valve housing and having a valve portion adapted to abut against and retract from the valve seat and thereby close and open the nozzle, respectively; and an adapter fixed to a front end of the valve housing. The adapter is formed with an atomizer hole communicating with the nozzle and an assist air passage extending through a side wall of the adapter for supplying an assist air into the atomizer hole to atomize the columnar fuel injected from the nozzle. Both the valve portion and the valve seat are formed to have surfaces in a conical shape so that upon retraction of the valve portion, the space generated between the surfaces becomes uniform over substantially the length of the surfaces.

16 Claims, 11 Drawing Sheets

INJECTOR WITH ASSIST AIR PASSAGE FOR ATOMIZING FUEL

BACKGROUND OF THE INVENTION

The present invention relates to a fuel injector for injecting atomized fuel to an engine, and more particularly to an improvement in atomization of the fuel to be injected from such a fuel injector to the engine.

FIG. 18 shows a front portion of a conventional fuel injector most pertinent to the present invention. Referring to FIG. 18, reference numeral 101 designates a casing of the injector for fixedly mounting a valve housing 102 therein. The valve housing 102 is formed at its front end with a nozzle 103 for injecting fuel and a valve seat 104 continuing inwardly from the nozzle 103. A valve body 105 is reciprocatably mounted in the valve housing 102. A spherical valve member 105*a* adapted to contact the valve seat 104 is fixed to a front end of the valve body 105. When the valve body 105 is moved upwardly as viewed in FIG. 18, a gap is defined between the valve seat 104 and the valve member 105*a* to permit pass of the fuel therethrough and inject the fuel from the nozzle 103.

A cylindrical adapter 106 is fixed to a front end portion of the valve housing 102. The adapter 106 is formed with an atomizer hole 107 communicating with the nozzle 103. The adapter 106 is further formed with a plurality of assist air passages 108 extending through a side wall of the adapter 106 for supplying an assist air into the atomizer hole 107, so as to atomize the fuel injected from the nozzle 103 into the atomizer hole 107.

While the spherical valve member 105*a* is shown in FIG. 18 by way of example, a pintle-type valve member having a needle partially inserted into the nozzle is also known.

In the prior art injector having the spherical valve member or the pintle-type valve member, the fuel injected from the nozzle 103 is not straightened or not in a columnar shape. Accordingly, the correlation in flow between the injected fuel and the assist air colliding with the same does not become constant, and a spray contour of the atomized fuel becomes unstable.

As a result, the atomized fuel is partially deposited onto an inner wall of the adapter 106, and the deposited fuel is further coagulated to form fuel drops 109. Admission of such fuel drops 109 into an engine makes unstable an air-fuel ratio of a fuel mixture to be supplied to the engine, causing a fluctuation in engine speed.

Further, as the spray contour of the atomized fuel is unstable, the atomized fuel injected from the atomizer hole 107 is deposited onto an inner wall of a suction pipe mounting the injector thereto, which also causes the fluctuation in air-fuel ratio.

Further, as the correlation in flow between the injected fuel and the assist air is not constant, the atomization of the injected fuel by the assist air becomes nonuniform to cause a variation in particle size of the atomized fuel, resulting in a reduction in combustion efficiency of the atomized fuel in the engine.

SUMMARY OF THE INVENTION

It is an object of the present invention to provide a fuel injector which can well straighten the columnar fuel to be injected from the nozzle.

It is another object of the present invention to provide a fuel injector which can uniformly atomize the columnar fuel injected from the nozzle by blowing an assist air against the columnar fuel well straightened.

It is a further object of the present invention to provide a fuel injector which can stabilize a spray contour of the atomized fuel to be injected from the atomizer hole.

According to the present invention, there is provided a fuel injector comprising a valve housing having a nozzle for columnarly injecting fuel and a valve seat continuing from said nozzle; a valve body reciprocatably mounted in said valve housing and having a valve portion adapted to abut against and retract from said valve seat and thereby close and open said nozzle, respectively; and an adapter fixed to a front end of said valve housing, said adapter being formed with an atomizer hole communicating with said nozzle and an assist air passage extending through a side wall of said adapter for supplying an assist air into said atomizer hole to atomize the columnar fuel injected from said nozzle; wherein both said valve portion and said valve seat are formed in a conical shape.

As both the valve portion and the valve seat are formed in a conical shape, the gap defined therebeween upon retraction of the valve portion from the valve seat has a substantially uniform space over the substantially entire length of the opposed surfaces along the flow of the fuel passing through the gap. Accordingly, the flow of the fuel passing through the gap is well straightened, and the columnar fuel injected from the nozzle is also straightened.

Furthermore, as the assist air is blown from the assist air passage into the atomizer hole against the columnar fuel straightened as mentioned above, the correlation in flow between the columnar fuel and the assist air can be stabilized to uniformly atomize the columnar fuel. Additionally, as the spray contour of the atomized fuel is also stabilized, the deposition of the atomized fuel onto the inner walls of the adapter and the suction pipe can be effectively reduced.

The invention will be more fully understood from the following detailed description and appended claims when taken with the drawings.

DETAILED DESCRIPTION OF THE PREFERRED EMBODIMENTS

Figure 1:
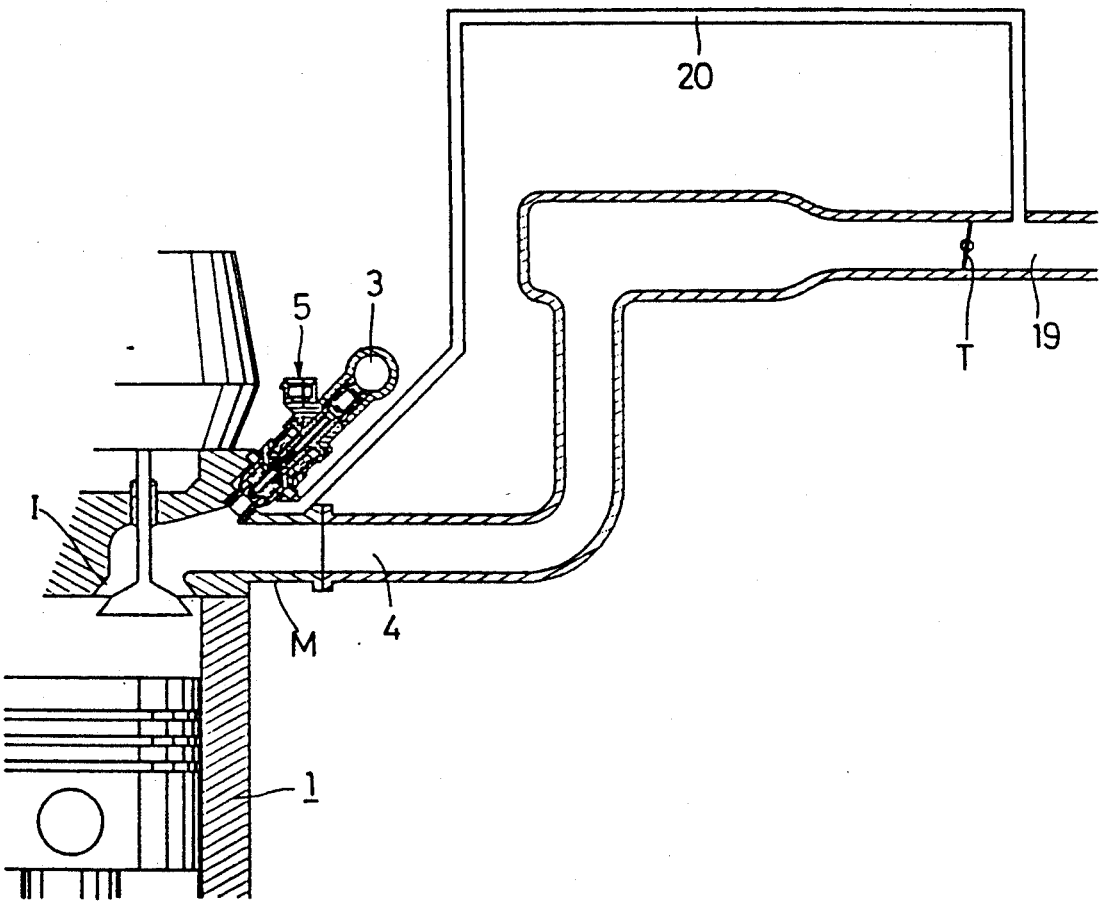
FIG. 1 is a vertical sectional view of a mounting construction of the injector according to the present invention with respect to an engine.

Referring to FIG. 1, reference numeral 1 designates an engine having a plurality of cylinders each having one intake port I. An intake manifold M is mounted to the engine 1 in such that a plurality of branch pipes of the intake manifold M are connected to the cylinders of the engine 1, respectively. A fuel injector 5 is mounted to each branch pipe of the intake manifold M. The fuel injector 5 is directed to the intake port I of each cylinder.

A fuel delivery pipe 3 is connected to a rear end of the fuel injector 5, so as to supply a pressure fuel into the fuel injector 5.

A suction pipe 4 is connected to an upstream end of the intake manifold M. A throttle valve T for controlling an amount of suction air to be supplied to the engine 1 is provided in the suction pipe 4. An assist air induction passage 20 is bypassed from the suction pipe 4 at a position upstream of the throttle valve T, and is connected to a front end portion of the fuel injector 5, which will be hereinafter described in more detail.

Figure 2:
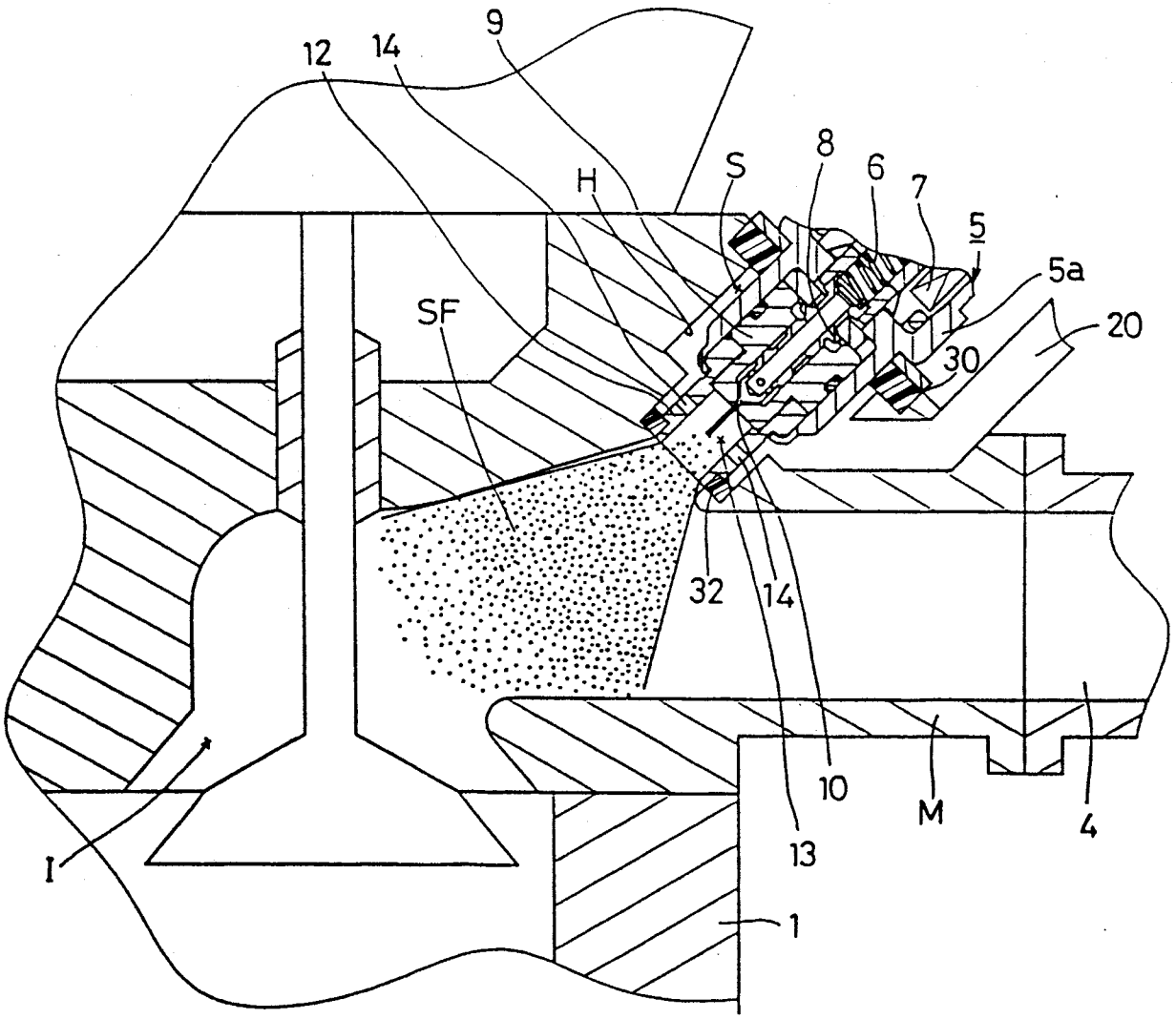
FIG. 2 is an enlarged view of an essential part shown in FIG. 1.

Referring to FIG. 2 which shows an enlarged view of a mounting construction of the fuel injector 5 shown in FIG. 1, the fuel injector 5 includes a casing 5*a*, a valve housing 9 fixedly mounted in the casing 5*a* at a front portion thereof, and a valve body 8 reciprocatably mounted in the valve housing 9. The valve housing 9 is formed at its front end with a nozzle 10 for columnarly injecting fuel. The valve body 8 is biased by a compression spring 6 mounted in the casing 5*a*, so that the nozzle 10 is normally closed by the valve body 8. A solenoid coil 7 is provided around the compression spring 6 in the casing 5*a*, so that when the solenoid coil 7 is excited, the valve body 8 is upwardly moved by a magnetic force generated by the solenoid coil 7, thereby injecting the fuel from the nozzle 10.

A cylindrical adapter 12 is fixed to the front end portion of the valve housing 9. The adapter 12 is axially formed with a cylindrical atomizer hole 13 communicating at its upper end with the nozzle 10 and opening at its lower end into the branch pipe of the intake manifold M. The adapter 12 is further formed with a plurality of cylindrical assist air passages 14 extending through a side wall of the adapter 12. Each assist air passage 14 is directed in such that an extension of a center line of the assist air passage 14 intersects an extension of a center line of the nozzle 10 at right angles.

The injector 5 is inserted in a mounting hole H formed through a wall of the branch pipe of the intake manifold M, and is fixed through upper and lower seal members 30 and 32 to the branch pipe. A sealed air chamber S is defined between an inner surface of the mounting hole H and outer surfaces of the casing 5*a* and the adapter 12. The sealed air chamber S is communicated with the assist air passages 14.

Referring back to FIG. 1, an assist air (atmospheric air) is induced from the suction pipe 4 at a position upstream of the throttle valve T through the air induction passage 20 to the sealed air chamber S. Then, the assist air is supplied from the sealed air chamber S through the assist air passages 14 into the atomizer hole 13 of the adapter 12.

Figure 3:
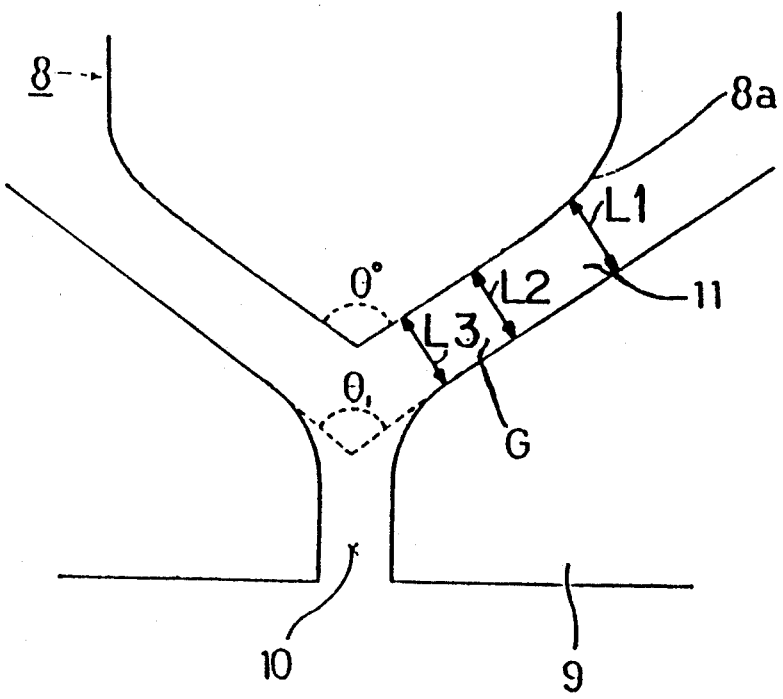
FIG. 3 is a further enlarged view of a valve portion and a valve seat of the injector shown in FIG. 2.

Referring to FIG. 3 which shows an enlarged view of the condition where the valve body 8 is upwardly moved to open the nozzle 10, reference numeral 8*a* designates a conical valve portion formed at the front or lower end of the valve body 8, and reference numeral 11 designates a conical valve seat so formed as to inwardly curvedly continue from the nozzle 10 and adapted to contact valve portion 8*a*.

Figure 4:
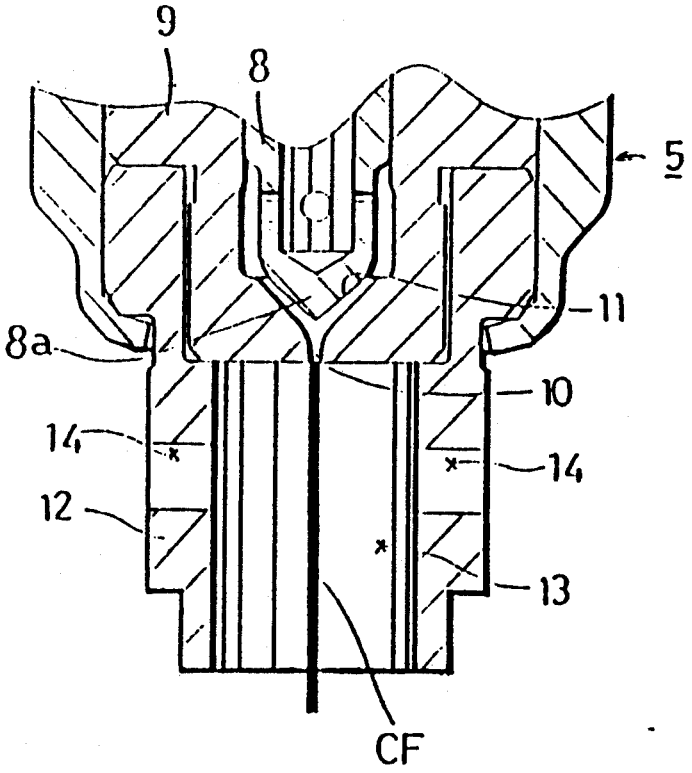
FIG. 4 is an enlarged view of a front portion of the injector for explaining a straightened condition of the columnar fuel injected from the nozzle, assuming that no assist air is supplied from the assist air passage.

The conical valve portion 8*a* has a vertex angle $\theta_0$, and the conical valve seat 11 has a phantom vertex angle $\theta_1$ almost equal to the vertex angle $\theta_0$ of the conical valve portion 8*a* (Strictly, the vertex angle $\theta_0$ is slightly larger than the vertex angle $\theta_1$). Under the open condition of the valve body 8 shown in FIG. 3, a gap G is defined between the valve portion 8*a* and the valve seat 11 for allowing flow of the fuel. Since the vertex angle $\theta_0$ of the valve portion 8*a* is almost equal to the vertex angle $\theta_1$ of the valve seat 11, the gap G has a substantially uniform space L between opposed surfaces of the valve portion 8*a* and the valve seat 11 over the substantially entire length thereof along the flow of the fuel passing through the gap G. If the valve portion 8*a* is formed as a spherical member as in the prior art, the space L becomes non-uniform, that is, it is widely varied. To the contrary, according to the preferred embodiment, as the valve portion 8*a* is conical, the space L becomes substantially uniform. Accordingly, the flow of the fuel passing through the gap G can be well straightened. As a result, when the fuel is columnarly injected from the nozzle 10 into the atomizer hole 13, the flow of such a columnar fuel from the nozzle 10 can be straightened as shown in FIG. 4. However, for the purpose of merely explaining the straight flow of the columnar fuel, FIG. 4 shows a phantom condition where no assist air is supplied from the assist air passages 14 of the adapter 12.

Figure 5:
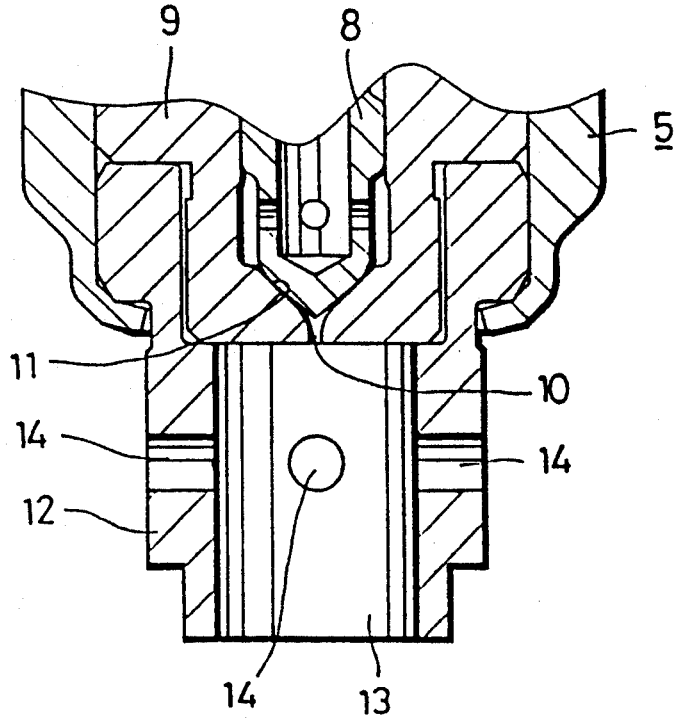
FIG. 5 is a view similar to FIG. 4, showing a preferred embodiment of the adapter.

Referring to FIG. 5 which shows a preferred embodiment of the adapter 12, four assist air passages 14 are formed through the side wall of the adapter 12 in such a manner that they are located at circumferentially equal intervals, that is, at 90 degrees apart from each other.

Figure 6:
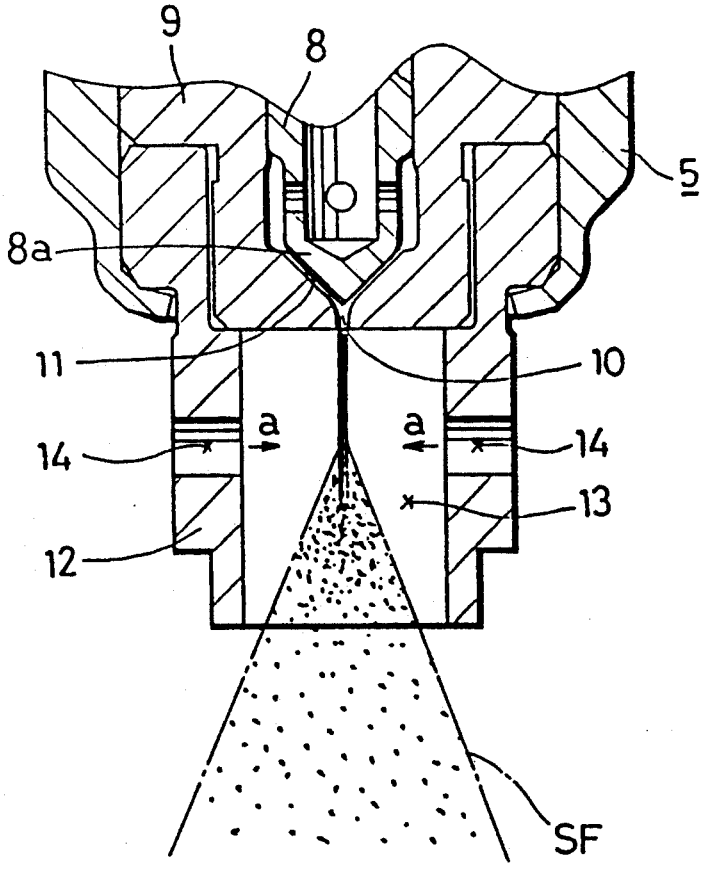
FIG. 6 is a view similar to FIG. 4, showing an atomized condition of the columnar straightened fuel as atomized by the assist air.

As shown in FIG. 6, when the valve portion 8*a* is moved away from the valve seat 11, the fuel is columnarly and straightly injected from the nozzle 10 into the atomizer hole 13. On the other hand, the assist air is blown from the assist air passages 14 into the atomizer hole 13 as shown by arrows a owing to a pressure difference between the upstream side and the downstream side of the throttle valve T in the suction pipe 4 (see FIG. 1). Accordingly, the assist air blown from the assist air passages 14 comes into collision with the columnar fuel injected from the nozzle 10 into the atomizer hole 13. Thus, the columnar fuel in the atomizer hole 13 is atomized by the assist air.

As both the valve portion 8a and the valve seat 11 are conical, the columnar fuel injected from the nozzle 10 is well straightened and stabilized. Accordingly, the correlation in flow between the columnar fuel and the assist air can be made stable. As a result, a whole amount of the columnar fuel injected from the nozzle 10 can be substantially uniformly atomized, and a spray form SF of the atomized fuel can be stabilized to thereby greatly reduce the deposition of the atomized fuel onto the inner wall of the adapter 12 and suppress the coagulation of the fuel deposited onto the inner wall of the adapter 12. Furthermore, the deposition of the atomized fuel after injected from the atomizer hole 13 onto the inner wall of the branch pipe of the intake manifold M as shown in FIG. 2 (especially, onto the upper inner wall of the branch pipe) can be suppressed to thereby improve the accuracy of air-fuel ratio control.

Figure 7:
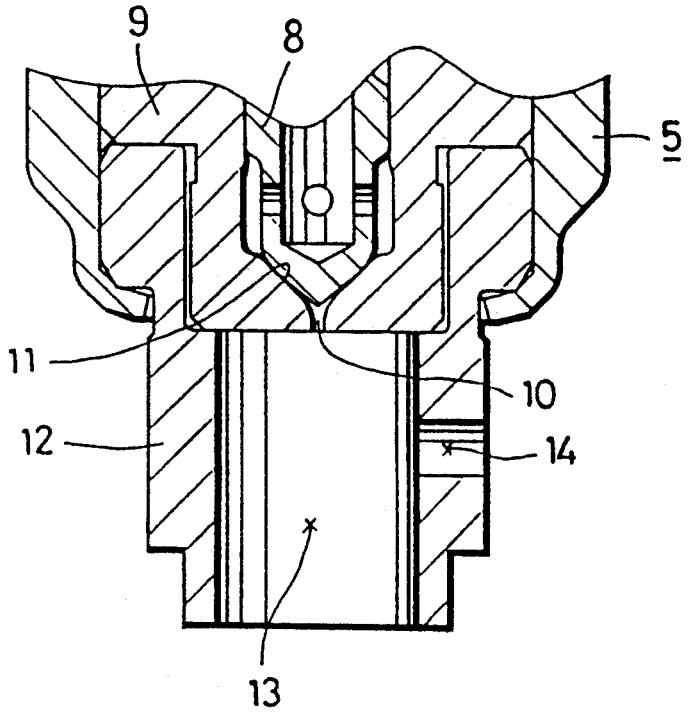
FIG. 7 is a view similar to FIG. 5, showing a second preferred embodiment of the adapter.

Referring to FIG. 7 shows a second preferred embodiment of the adapter 12, a single assist air passage 14 is formed through the side wall of the adapter 12.

Figure 8:
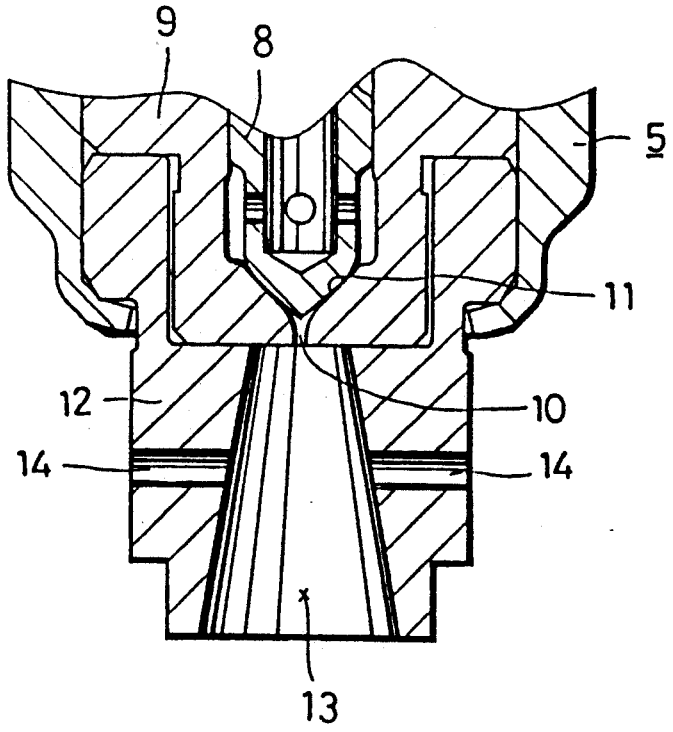
FIG. 8 is a view similar to FIG. 5, showing a third preferred embodiment of the adapter.

Referring to FIG. 8 which shows a third preferred embodiment of the adapter 12, the atomizer hole 13 is formed in a conical shape so as to diverge downwardly.

Figure 9:
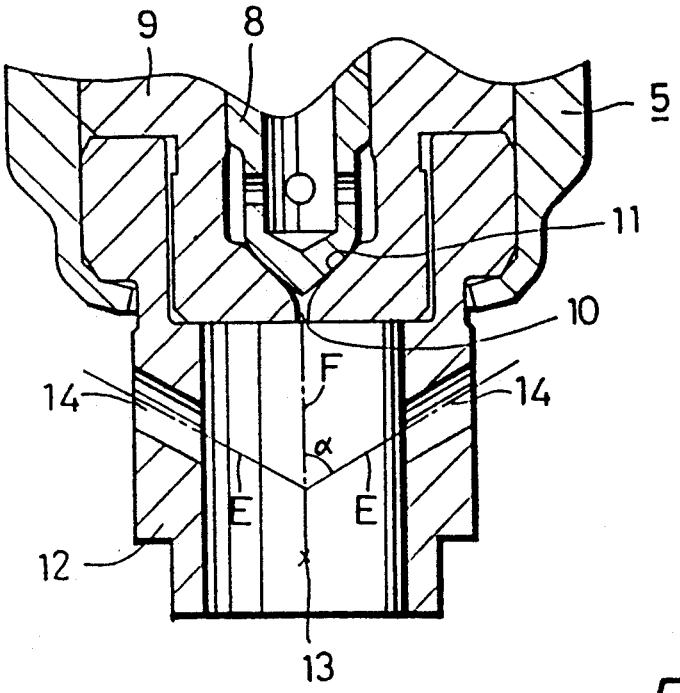
FIG. 9 is a view similar to FIG. 5, showing a fourth preferred embodiment of the adapter.

Referring to FIG. 9 which shows a fourth preferred embodiment of the adapter 12, each assist air passage 14 is inclined downwardly such that an intersecting angle $\alpha$ between the extension E of the center line of the assist air passage 14 and the extension F of the center line of the nozzle 10 is less than 90 degrees.

Figure 10:
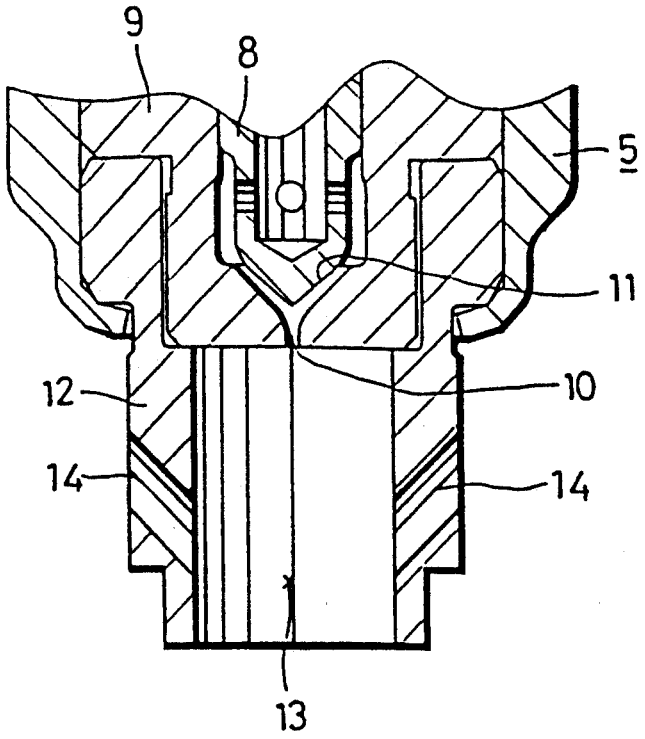
FIG. 10 is a view similar to FIG. 9, showing a fifth preferred embodiment of the adapter.

Referring to FIG. 10 which shows a fifth preferred embodiment of the adapter 12, each assist air passage 14 is inclined downwardly at the above-defined intersecting angle less than that in the fourth preferred embodiment shown in FIG. 9. Further, the location of each assist air passage 14 is lower than that in the fourth preferred embodiment shown in FIG. 9. It is to be understood that various other modifications of the adapter 12 in respect of the inclined angle and the location of each assist air passage 14 may be made.

Figure 11:
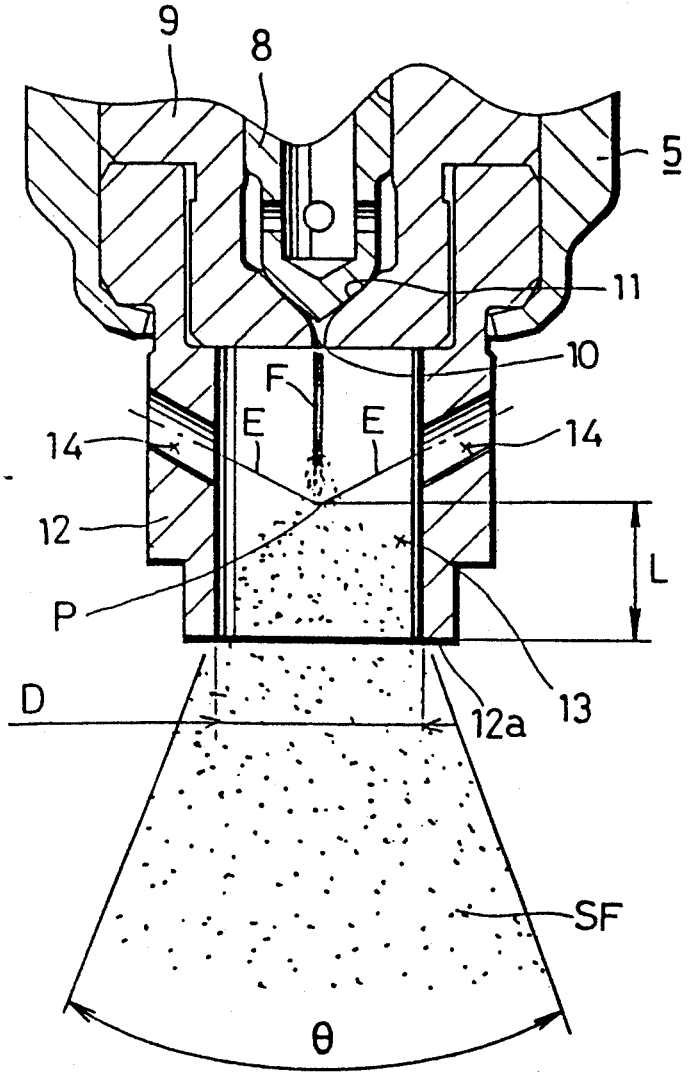
FIG. 11 is a view similar to FIG. 9, showing the relationship beween a location of the assist air passage and a spray angle of the atomized fuel.
Figure 12:
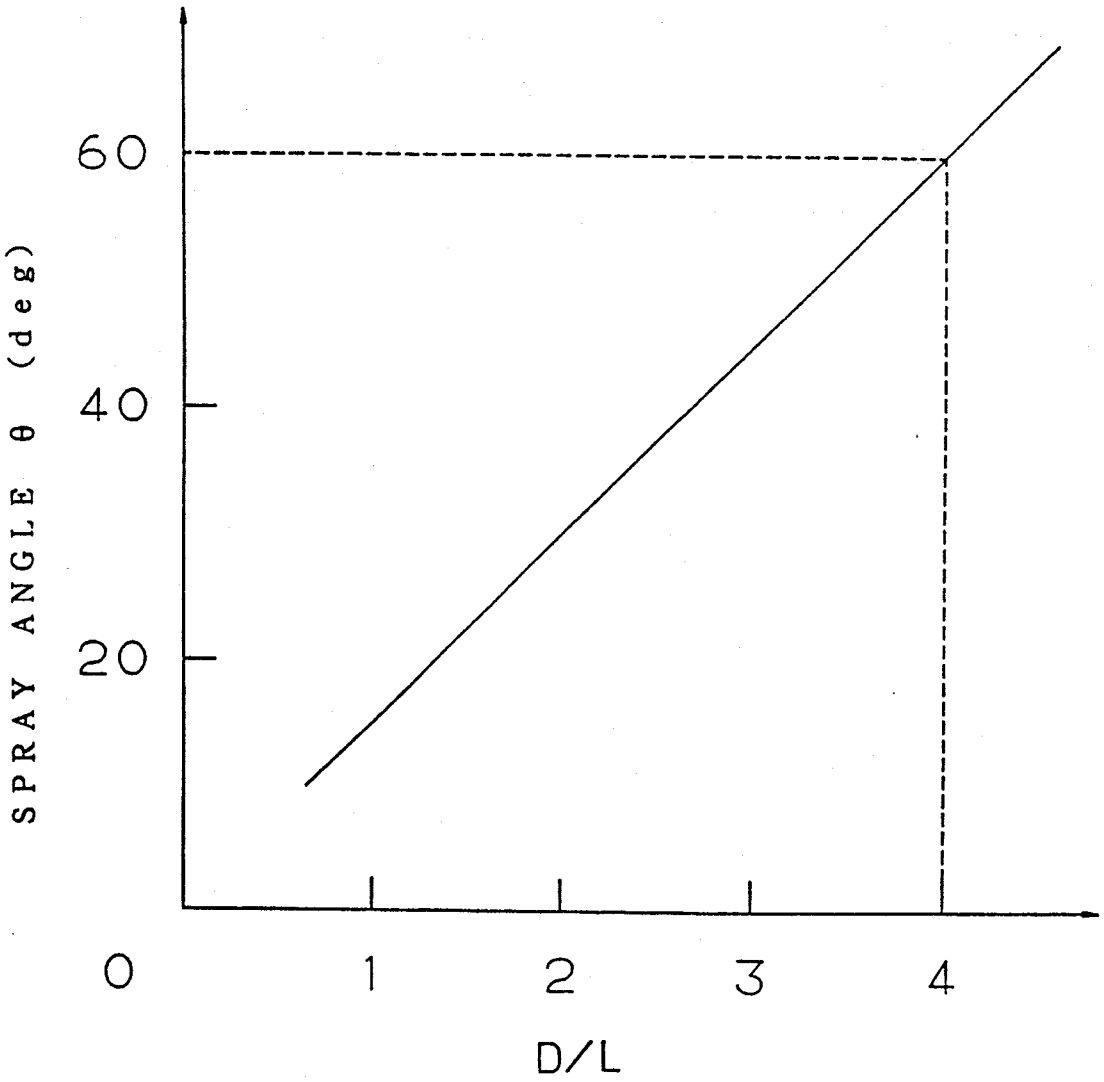
FIG. 12 is a graph quantitatively showing the relationship shown in FIG. 11.

The present inventors have found from various tests that a spray angle of the atomized fuel can be controlled by controlling the relationship between a diameter of the atomizer hole 13 and a position of intersection between the assist air flow and the columnar fuel flow. That is, as shown in FIG. 11, let D denote a diameter of the atomizer hole 13; L denote a distance from an intersecting point P between the extension E of the center line of each assist air passage 14 and the extension F of the center line of the nozzle 10 to a front end 12a of the adapter 12; and $\theta$ denote a spray angle of the atomized fuel SF injected from the atomizer hole 13. In this case, the spray angle $\theta$ can be controlled according to the ratio of D/L. FIG. 12 shows the relationship between the spray angle $\theta$ and the ratio D/L. As apparent from FIG. 12, the spray angle $\theta$ can be controlled to 60 degrees or less by setting the ratio D/L to 4 or less. Accordingly, the deposition of the atomized fuel onto the inner wall of the adapter 12 can be minimized by suitably setting the spray angle $\theta$.

Figure 13:
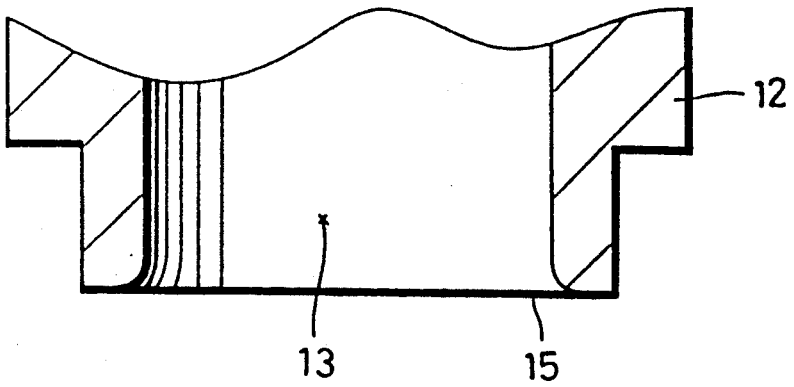
FIG. 13 is an enlarged view of a preferred embodiment of an outlet opening of the atomizer hole.

Referring to FIG. 13 which is an enlarged view of the front end portion of the adapter 12, an outlet opening 15 of the atomizer hole 13 is rounded at an inner circumference thereof, so as to prevent that the coagulated fuel after the deposition onto the inner wall of the adapter 12 falls from the inner circumferential edge of the outlet opening 15.

Figure 14:
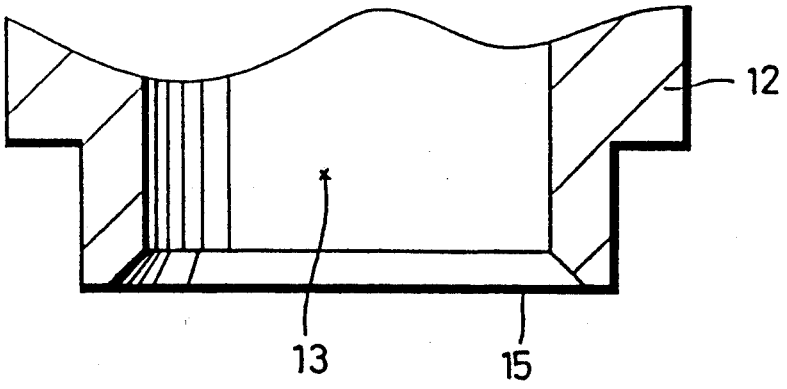
FIG. 14 is a view similar to FIG. 13, showing another preferred embodiment.

Referring to FIG. 14 which shows a modification of FIG. 13, the outlet opening 15 is chamfered at its inner circumference, so as to obtain the same effect as that in FIG. 13.

Figure 15:
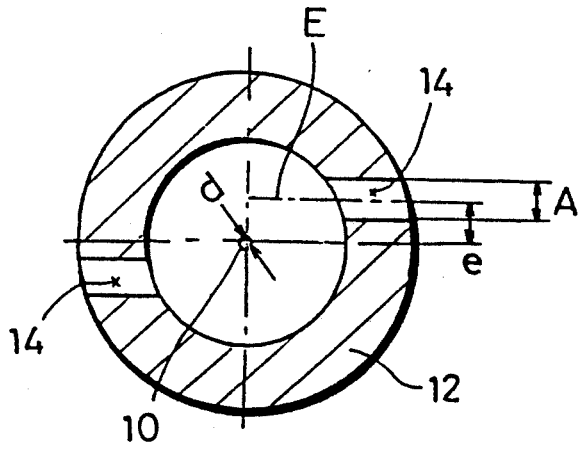
FIG. 15 is a horizontal sectional view of the adapter, showing an offset location of the assist air passages with respect to the columnar fuel from the nozzle.
Figure 16:
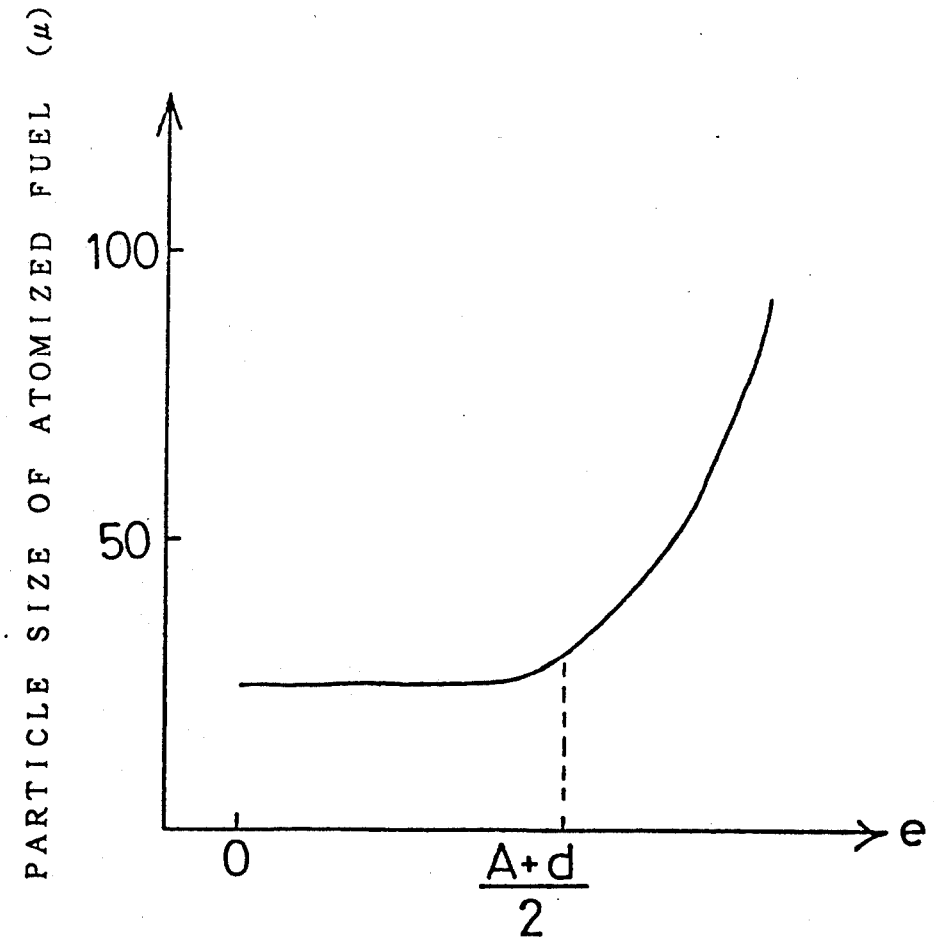
FIG. 16 is a graph showing the relationship between an offset quantity of the assist air passages shown in FIG. 15 and a particle size of the atomized fuel.

The present inventors have further found from various tests that a radially offset quantity of the assist air passage with respect to the columnar fuel flow from the nozzle 10 is related with a particle size of the atomized fuel. That is, referring to FIG. 15 which is a horizontal sectional view of the adapter 12, the two assist air passages 14 are radially offset from the extension of the center line of the nozzle 10. Letting d denote a diameter of the nozzle 10; A denote a diameter of each assist air passage 14; and e denote a distance (offset quantity) from the extension of the center line of the nozzle 10 to the extension E of the center line of the assist air passage 14, the distance e is related with the particle size of the atomized fuel as shown in FIG. 16. As apparent from FIG. 16, when the distance e is less than $(A+d)/2$, the particle size of the atomized fuel becomes small.

Figure 17:
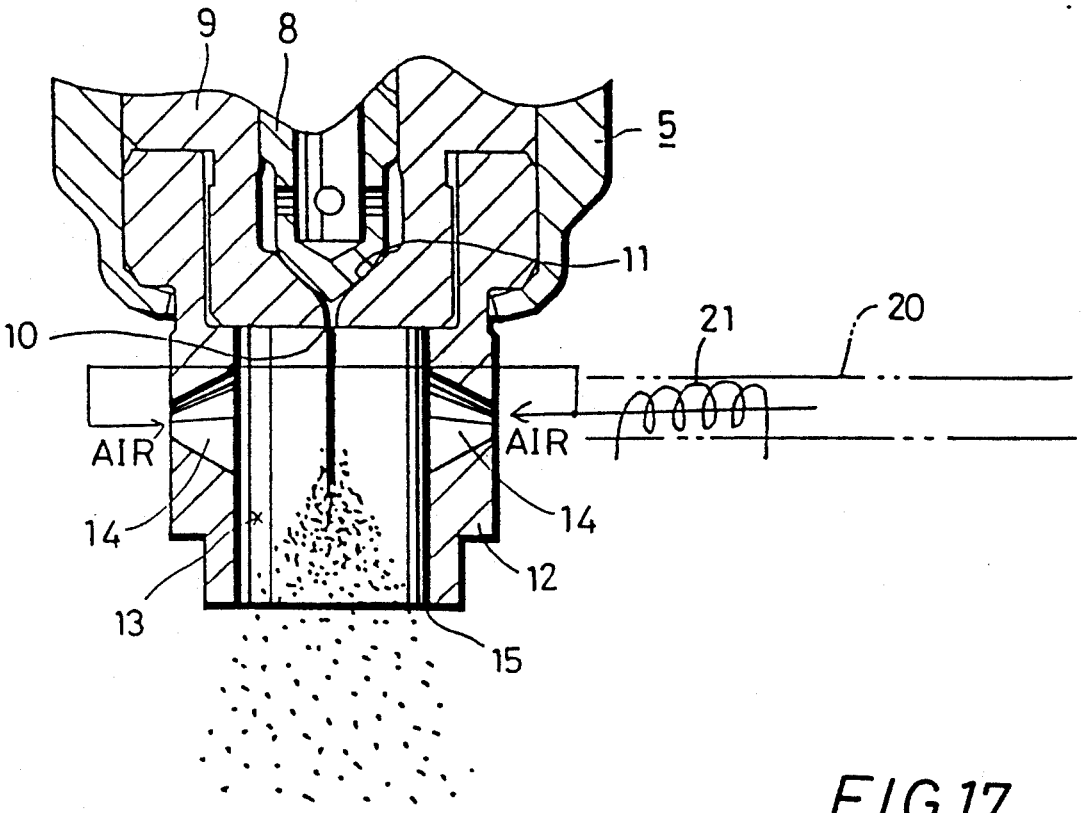
FIG. 17 is a view similar to FIG. 6, showing another preferred embodiment of the present invention having a heater for heating the assist air.
Figure 18:
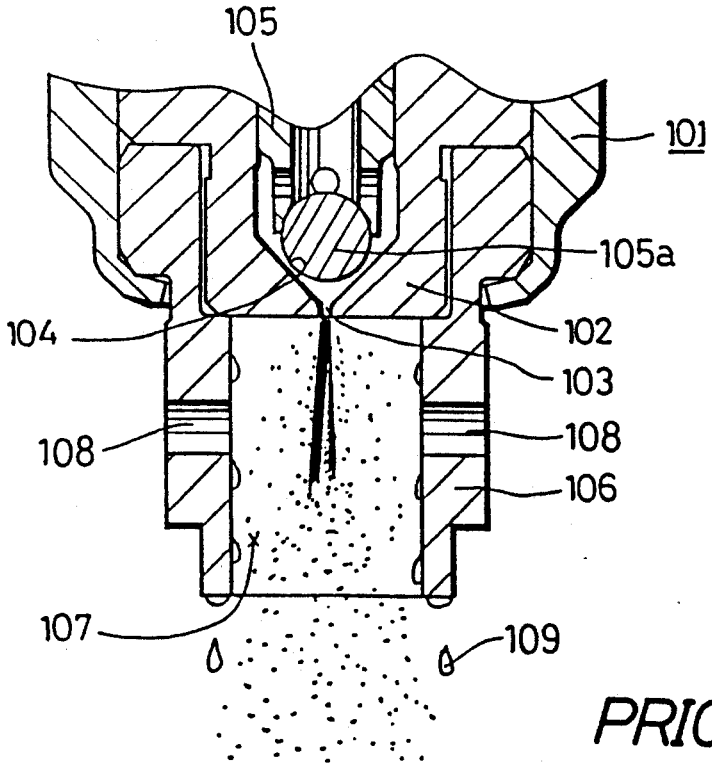
PRIOR ART FIG.18
FIG. 18 is a vertical sectional view of a front portion of the fuel injector in the prior art.

Referring to FIG. 17 which shows another preferred embodiment of the present invention, each assist air passage 14 is formed in a conical shape so as to diverge toward the atomizer hole 13. Furthermore, a heater 21 is provided in the air induction passage 20, so as to heat the assist air to be supplied to the assist air passages 14, thereby further improving the atomization of the fuel in the atomizer hole 13.

Further, the inner wall of the adapter 12 may be coated with polytetrafluoroethylene, or may be mirror-finished, so as to facilitate the prevention of the deposition of the atomized fuel onto the inner wall of the adapter 12.

Having thus described the preferred embodiments of the invention, it should be understood that numerous structural modifications and adaptations may be made without departing from the spirit of the invention.

What is claimed is:

1. A fuel injector comprising:

a valve housing having a nozzle for columnarly injecting fuel and a valve seat continuing from said nozzle;

a valve body reciprocatably mounted in said valve housing and having a valve portion adapted to abut against and retract from said valve seat and thereby close and open said nozzle, respectively;

an adapter fixed to a front end of said valve housing, said adapter being formed with an atomizer hole communicating with said nozzle and at least one assist air passage extending through a side wall of said adapter for supplying an assist air into said atomizer hole to atomize the columnar fuel injected from said nozzle; and wherein both said valve portion and said valve seat are formed in a conical shape, a vertex angle of said conical valve portion is almost equal to that of said conical valve seat, said nozzle is formed along the axis of the conical shape, and said nozzle continues to the conical shape of said valve seat in a smooth curve, so that the width of the gap formed between said valve seat and said valve portion is substantially uniform all the way to the nozzle when said valve body retracts from said valve seat.

2. The fuel injector as defined in claim 1, wherein the number of said assist air passage is at least two.

3. The fuel injector as defined in claim 2, wherein said assist air passages are arranged at circumferentially equal intervals.

4. The fuel injector as defined in claim 1, wherein said assist air passage is formed in a cylindrical shape.

5. The fuel injector as defined in claim 1, wherein said assist air passage is formed in a conical shape so as to diverge toward said atomizer hole.

6. The fuel injector as defined in claim 1, wherein said atomizer hole is formed in a cylindrical shape.

7. The fuel injector as defined in claim 1, wherein said atomizer hole is formed in a conical shape so as to diverge toward a front end of said adapter.

8. The fuel injector as defined in claim 1, wherein an extension of a center line of said assist air passage intersects an extension of a center line of said nozzle at right angles.

9. The fuel injector as defined in claim 1, wherein an extension of a center line of said assist air passage intersects an extension of a center line of said nozzle at acute angles in such that said assist air passage is inclined toward an outlet opening of said atomizer hole.

10. The fuel injector as defined in claim 1, wherein a ratio (D/L) between a diameter (D) of said atomizer hole and a distance (L) from an intersecting point between an extension of a center line of said nozzle and an extension of a center line of said assist air passage to an outlet opening of said atomizer hole is set to 4 or less, whereby a spray angle of the atomized fuel in said atomizer hole is set to 60 degrees or less.

11. The fuel injector as defined in claim 1, wherein an extension of a center line of said assist air passage is radially offset from an extension of a center line of said nozzle, and an offset distance (e) from the extension of the center line of said assist air passage to the extension of the center line of said nozzle is set to be less than $(A+d)/2$ where A represents a diameter of said assist air passage, and d represents a diameter of said nozzle.

12. The fuel injector as defined in claim 1, wherein an outlet opening of said atomizer hole is rounded at an inner cicumference thereof.

13. The fuel injector as defined in claim 1, wherein an outlet opening of said atomizer hole is chamfered at an inner circumference thereof.

14. The fuel injector as defined in claim 1 further comprising a heater for heating the assist air to be supplied to said assist air passage.

15. The fuel injector as defined in claim 1, wherein an inner wall of said adapter forming said atomizer hole is coated with polytetrafluoroethylene.

16. The fuel injector as defined in claim 1, wherein an inner wall of said adapter forming said atomizer hole is mirror-finished.

* * * * *